US005239836A

United States Patent [19]

Sakai

[11] Patent Number: 5,239,836

[45] Date of Patent: Aug. 31, 1993

[54] ELECTRIC CONTROL APPARATUS FOR ICE MAKING MACHINE

[75] Inventor: Tadashi Sakai, Toyoake, Japan

[73] Assignee: Hoshizaki Kenki Kabushiki Kaisha, Toyoake, Japan

[21] Appl. No.: 839,564

[22] Filed: Feb. 24, 1992

[30] Foreign Application Priority Data

Feb. 22, 1991 [JP] Japan ..... 3-050551

[51] Int. Cl.[5] ..... F25C 1/00

[52] U.S. Cl. ..... 62/233; 62/348; 261/DIG. 46

[58] Field of Search ..... 62/233, 347, 348; 261/DIG. 46; 122/382

[56] References Cited

U.S. PATENT DOCUMENTS

| | | | |
|---|---|---|---|
| 4,347,430 | 8/1982 | Howard-Leicester et al. | 122/382 |
| 4,774,814 | 10/1988 | Yingst et al. | 62/126 |
| 4,785,641 | 11/1988 | McDougal | 62/233 |
| 4,934,159 | 6/1990 | Sakai et al. | 62/347 |

FOREIGN PATENT DOCUMENTS

| | | |
|---|---|---|
| 63-105381 | 5/1988 | Japan . |
| 2171188 | 8/1986 | United Kingdom . |

*Primary Examiner*—William E. Wayner

*Attorney, Agent, or Firm*—Nikaido, Marmelstein, Murray & Oram

[57] ABSTRACT

An electric control apparatus for an ice making machine having an upright ice making plate arranged above a water tank, a water valve arranged to be opened during the defrost cycle of operation for supplying fresh water into the water tank through the ice making plate, a refrigeration circuit including an evaporator arranged for thermal exchange with the ice making plate, a water pump arranged to circulate the fresh water from the water tank to the upright ice making plate during the ice making cycle of operation and to discharge the water remained in the water tank after the ice making cycle of operation during the drain cycle of operation. The electric control apparatus includes mean for repetitively conducting the defrost cycle of operation, the ice making cycle of operation and the drain cycle of operation in sequence, means for counting up a cycle count value at each time of conducting the ice making cycle of operation, means for selecting a discharge frequency of the water remained in the water tank, and means for prohibiting the drain cycle of operation when the cycle count value is less than a reference value indicative of the selected discharge frequency and for allowing the drain cycle of operation when the cycle count value becomes equal to the reference value.

5 Claims, 7 Drawing Sheets

ELECTRIC CONTROL APPARATUS FOR ICE MAKING MACHINE

BACKGROUND OF THE INVENTION

1. Field of the Invention

The present invention relates to an ice making machine of the type wherein fresh water is supplied into a water tank through an upright ice making plate during the defrost cycle of operation and circulated as ice making water from the water tank to the ice making plate during the ice making cycle of operation to be frozen into ice cubes, and wherein the water remained in the water tank after the ice making cycle of operation is discharged during the drain cycle of operation. More particularly, the present invention relates to an electric control apparatus for the ice making machine for controlling the drain cycle of operation in accordance with the quality of water in the water tank.

2. Discussion of the Prior Art

In Japanese Patent Laid-open Publication No. 63-105381, there is disclosed an ice making machine of this type which includes a water valve arranged to be opened during the defrost cycle of operation for supplying fresh water from a water service pipe into a water tank through an upright ice making plate and a water pump arranged to circulate the fresh water from the water tank to the ice making plate during the freezing cycle of operation and to discharge the remaining water from the water tank after the freezing cycle of operation thereby to eliminate accumulation of contaminants in the water tank. In the ice making machine, however, the water pump is inevitably operated after the freezing cycle of operation to discharge the remaining water form the water tank irrespectively of the quality of water. This results in waste of the fresh water supplied into the water tank during the defrost cycle of operation.

SUMMARY OF THE INVENTION

It is, therefore, a primary object of the present invention to provide an electric control apparatus for the ice making machine capable of avoiding useless discharge of the ice making water form the water tank during the drain cycle of operation.

According to the present invention, the primary object is accomplished by providing an electric control apparatus for an ice making machine having a water tank arranged to store an amount of ice making water, an upright ice making plate arranged above the water tank, a water valve arranged to be opened during the defrost cycle of operation for supplying fresh water into the water tank through the ice making plate, a refrigeration circuit including an evaporator arranged for thermal exchange with the ice making plate, a water pump arranged to circulate the fresh water from the water tank to the upright ice making plate during the ice making cycle of operation and to discharge the water remained in the water tank after the ice making cycle of operation during the drain cycle of operation, which comprises means for repetitively conducting the defrost cycle of operation, the ice making cycle of operation and the drain cycle of operation in sequence; means for counting up a cycle count value at each time of conducting the ice making cycle of operation; means for selecting a discharge frequency of the water remained in the water tank; and means for prohibiting the drain cycle of operation when the cycle count value is less than a reference value indicative of the selected discharge frequency and for allowing the drain cycle of operation when the cycle count value becomes equal to the reference value.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
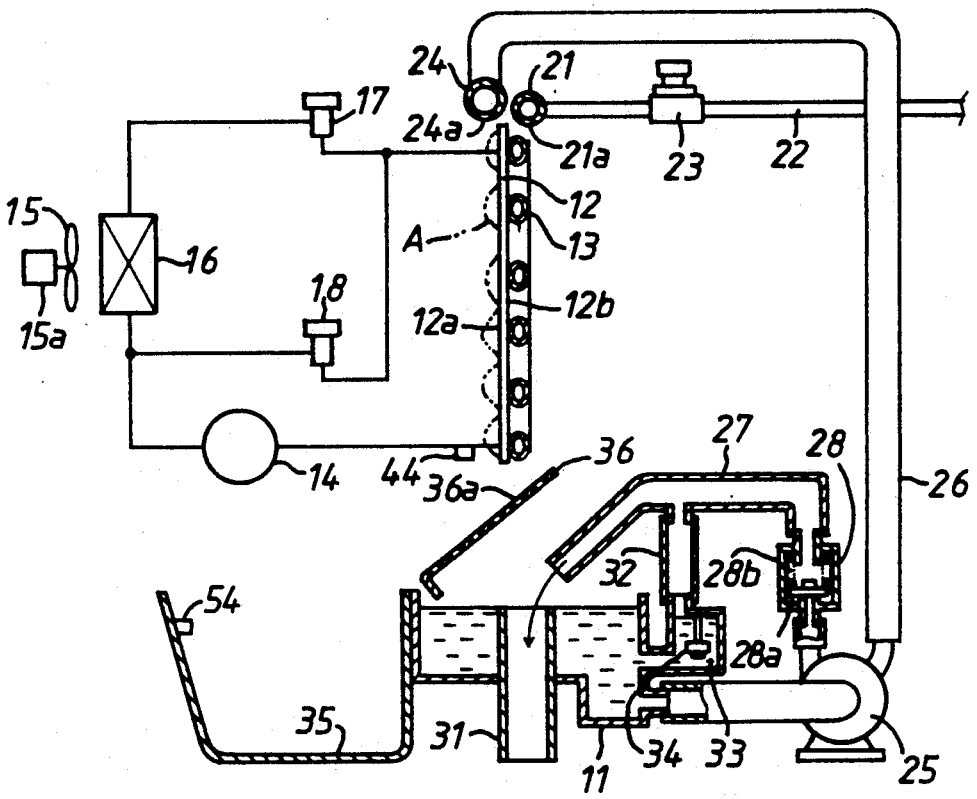
FIG. 1 is a schematic illustration of an ice making machine.

In FIG. 1 of the drawings, there is illustrated an ice making machine which is provided with a water tank 11 arranged to store an amount of ice making water and an upright ice making plate 12 of stainless sheet metal located above the water tank 11 to form ice cubes A on its front surface 12*a*. An evaporator coil 13 is welded to a rear surface of ice making plate 12 and connected at its inlet to an expansion valve 17 and at its outlet to a refrigerant compressor 14. In a refrigeration circuit of the ice making machine, the compressor 14 is connected at its outlet to a finned condenser 16 provided with a cooling fan 15 driven by an electric motor 15*a*, and the condenser 16 is connected at its outlet to the expansion valve 17. The compressor 14 is further connected at its outlet to the downstream of expansion valve 17 by way of a bypass line provided with an electrically operated hot gas valve 18 of the normally closed type. Arranged above the rear surface 12*b* of ice making plate 12 is a watering pipe 21 which is connected to a water service pipe 22 through an electrically operated water valve 23 of the normally closed type. When supplied with fresh water from the water service pipe 22 through the water valve 23, the watering pipe 22 renders the supplied water flow down from its sprinkler holes 21*a* along the rear surface 12*b* of ice making plate 12 as defrost water.

Arranged above the front surface 12*a* of ice making plate 12 is a watering pipe 24 which is connected to a water pump 25 through a water supply pipe 26. When supplied with ice making water from the water supply pipe 26 in operation of the water pump 25, the watering pipe 24 renders the supplied ice making water from down from its sprinkler holes 24*a* along the front surface 12*a* of ice making plate 12. The water pump 25 is driven by an electric reversible motor 25*a* to supply the ice making water into the water supply pipe 26 from the water tank 11 in its forward rotation and to supply the ice making water into a discharge pipe 27 from the water tank 11 in its reverse rotation. The discharge pipe 27 is provided with a pressure valve 28 which includes a valve body 28*a* loaded by a compression spring 28*b* downward to be normally closed. When applied with the water under pressure from the water pump 25, the valve body 28*a* is moved against the load of spring 28*b* to permit the flow of water into the discharge pipe 27. The outlet end of discharge pipe 27 is placed above an overflow 31 disposed within the water tank 11 to discharge the ice making water through the overflow pipe 31.

The discharge pipe 27 is connected to a sub-tank 33 through a pipe 32 to render a portion of the supplied water from into the sub-tank 33. The sub-tank 33 is communicated at its bottom portion with the water tank 11 and contains therein a float switch 34 which is arranged to be closed when the level of water in tank 11 becomes higher than a predetermined level and to be opened when the level of water in tank 11 becomes lower than the predetermined level. A perforated water plate 36 is tiltably arranged above the water tank 11 to permit the water flowing down therethrough into the water tank 11 from the ice making plate 12 and to receive ice cubes released from the ice making plate 12.

Figure 2:
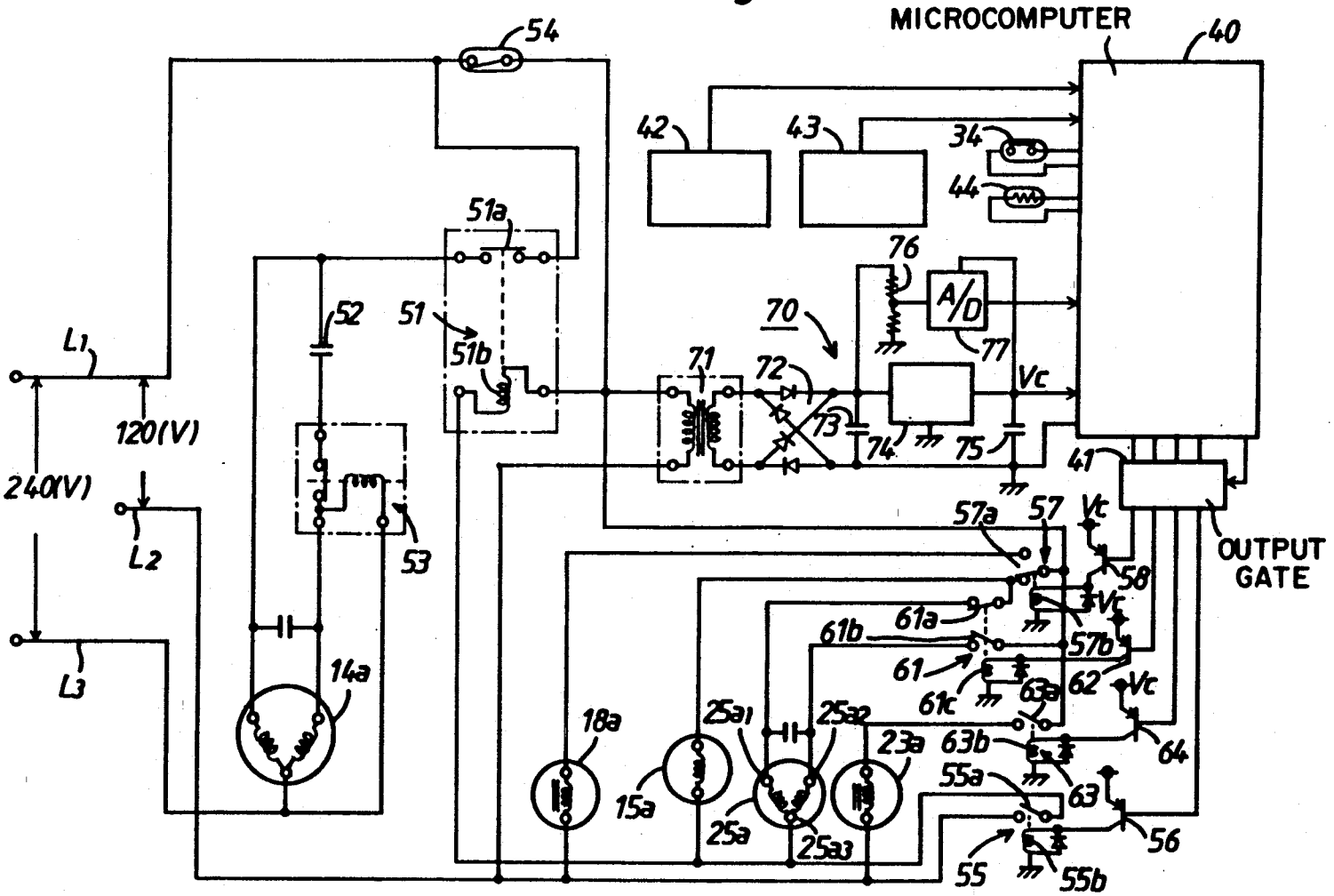
FIG. 2 is an electric control apparatus for the ice making machine in accordance with the present invention.

As shown in FIG. 2, an electric control apparatus for the ice making machine has three input buses $L_1$, $L_2$, $L_3$ connected to an electric motor 14*a* of the refrigerant compressor 14, a solenoid 18*a* of hot gas valve 18, the electric motor 15*a* of coiling fan 15, the electric motor 25*a* of water pump 25, a solenoid 23*a* of water valve 23 and a control circuit 40 for the electric motors and solenoids. The input buses $L_1$, $L_2$, $L_3$ are connected to a commercially available power source of the single-phase three-wire type. In this embodiment, the input buses $L_1$, $L_2$ are arranged to be applied with a source voltage of 120 volt, while the input buses $L_1$, $L_3$ are arranged to be applied with a source voltage of 240 volt.

The electric motor 14*a* of compressor 14 is connected at its one end to the input bus $L_1$ through a normally open contact of a relay switch 51 and at its other end to the input bus $L_3$. Interposed between the normally open contact 51*a* and the electric motor 14*a* are a drive capacitor 52 and a start relay 53. The normally open contact 51*a* is associated with a relay coil 51*b* which is connected at its one end to the input bus $L_1$ through a thermostat switch 54 and at its other end to the input bus $L_2$ through a normally open contact 55*a* of a relay switch 55. When applied with the source voltage of 120 volt, the relay coil 51*b* is energized to close the normally open contact 51*a*. As shown in FIG. 1, the thermostat switch 54 is mounted on an inside upper portion of an ice stocker 53 to be opened at a predetermined temperature when the ice stocker 53 has been filled with ice cubes. The normally open contact 55*a* of relay switch 55 is associated with a relay coil 55*b* which is grounded at its one end and connected at its other end to the collector of a switching transistor 56. When applied with a DC voltage Vc in response to energization of transistor 56, the relay coil 55*b* is energized to close the normally open contact 55*a*.

The solenoid 18*a* of hot gas valve 18 and the motor 15*a* of cooling fan 15 are connected at their one ends to the input bus $L_1$ through a movable contact 57*a* of a relay switch 57 and the thermostat switch 54. The solenoid 18*a* of hot gas valve 18 is connected at its other end to the input bus $L_2$, while the motor 15*a* of cooling fan 15 is connected at its other end to the input bus $L_2$ through the normally open contact 55*a* of relay switch 55. The movable contact 57*a* is retained in a first position during deenergization of the relay coil 57*b* to connect the electric motor 15*a* of cooling fan 15 to the input bus $L_1$ and is switched over in response to energization of the relay coil 57*b* from the first position to a second position to connect the solenoid 18*a* of hot gas valve 18 to the input bus $L_1$. The relay coil 57*b* is grounded at its one end and connected at its other end to the collector of a switching transistor 58 to be energized when the transistor 58 is turned on.

The electric motor 25*a* of water pump 25 has a first control terminal 25*a*$_1$ for forward rotation connected to the input bus $L_1$ through a normally closed contact 61*a* of a relay switch 61, the movable contact 57*a* of relay switch 57 and the thermostat switch 54, a second control terminal 25*a*$_2$ for reverse rotation connected to the input bus $L_1$ through a normally open contact 61*b* of relay switch 61 and the thermostat switch 54, and a common terminal 25*a*$_3$ connected to the input bus $L_2$ through the normally open contact 55*a* of relay switch 55. The relay switch 61 includes a relay coil 61*c* grounded at its one end and connected at its other end to the collector of a switching transistor 62. The normally closed contact 61*a* is opened in response to energization of the relay coil 61*c*, while the normally open contact 61*b* is closed in response to energization of the relay coil 61*c*. The solenoid 23*a* of water valve 23 is connected at its one end to the input bus $L_1$ through a normally open contact 63*a* of a relay switch 63 and the thermostat switch 54 and at its other end to the input bus $L_2$. The relay switch 63 includes a relay coil 63*b* grounded at its one end and connected at its other end to the collector of a switching transistor 64. When the transistor 64 is turned on, the relay coil 63*b* is energized to close the normally open contact 63*a*.

Figure 3:
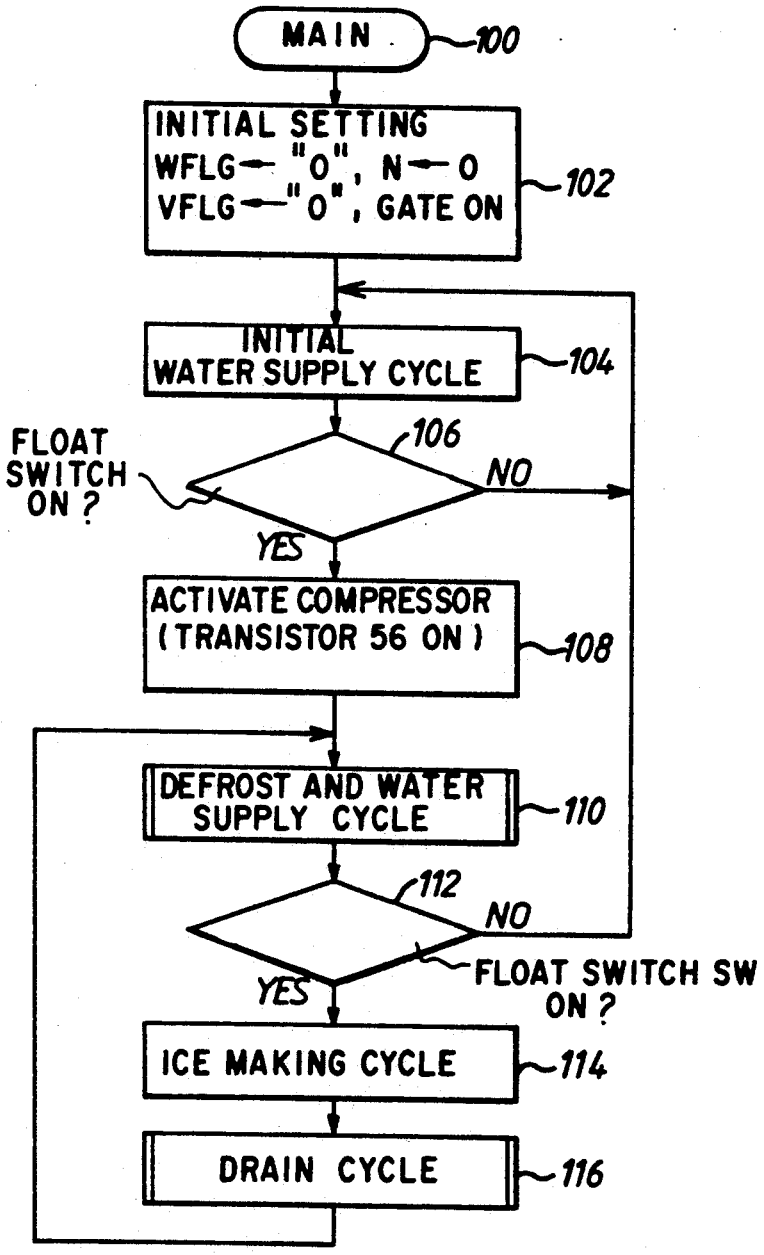
FIG. 3 is a flow chart of a main control program executed by a microcomputer shown in FIG. 2.
Figure 7:
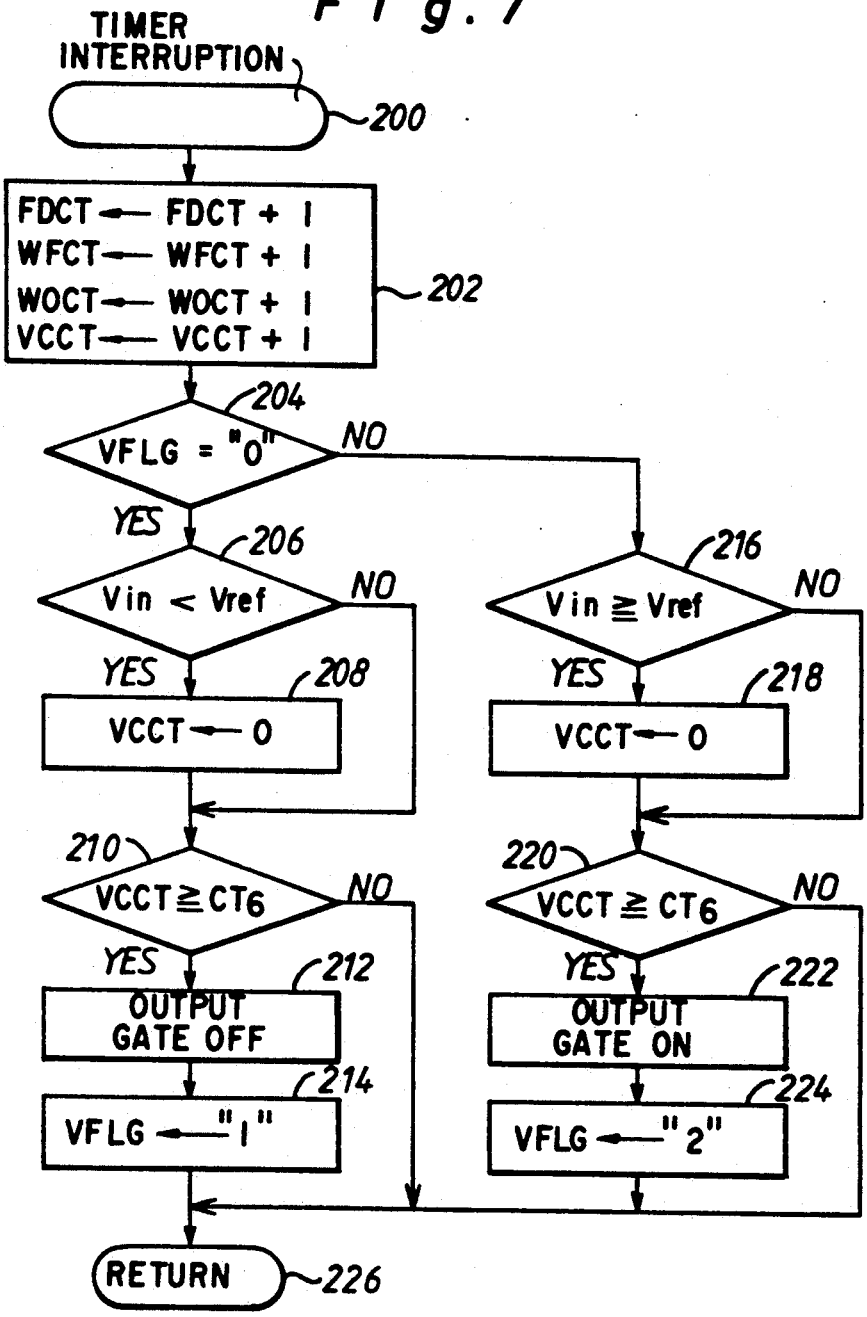
FIG. 7 is a flow chart of an interruption program executed by the computer.

The electric control circuit 40 is in the form of a microcomputer which is arranged to execute a main control program shown by a flow chart in FIG. 3 and to execute a timer interruption program for control of switching transistors 56, 58, 62, 64 shown by a flow chart in FIG. 7 when applied with an interruption signal from a timer at a predetermined time interval. The computer has an input/output device or I/O connected to the switching transistor 56, 58, 62, 64 through an output gate 41 which is turned on in response to an output control signal from the computer to selectively apply the control signal to the switching transistors 56, 58, 62 and 64. The I/O of computer 40 is connected to a DC power source circuit 70, a discharge time setting switch 42, a discharge frequency setting switch 43, a float switch 34 and a thermal sensor 44.

The DC power source circuit 70 includes a transformer 71 interposed between the input buses $L_1$ and $L_2$ through the thermostat switch 54, a full-wave rectifier 72 connected to the transformer 71 and a regulator 74 connected at its input to the full-wave rectifier 72 through a smoothing condenser 73. The regulator 74 is connected at its output to the computer 40 through a smoothing condenser 75 to apply a DC voltage Vc of, for instance, 5 Volt. In addition, the switching transistors 56, 58, 62 64 are arranged to be applied with the DC voltage Vc from regulator 74. The regulator 74 is further connected at its input to a voltage divider 76 composed of two resistors connected in series to one another. When applied with an AC voltage of 120 volt from the transformer 71, the voltage divider 76 produces an AC voltage of about 2.5 volt and applies it to the computer 40 through an A/D converter 77. The AC voltage is converted by the A/D converter 77 into a digital signal to be applied to the computer 40 for checking an input voltage applied to the input buses $L_1$ and $L_2$. The A/D converter 77 is also arranged to be applied with the output voltage Vc of regulator 74 as a power source voltage.

The discharge time setting switch 42 is composes of a plurality of selection switches which are selectively operated to produce an electric signal representing a discharge time (for instance, 0, 10 or 20 second) for discharge of the ice making water from tank 11. The discharge frequency setting switch 43 is composed of a plurality of selection switches which are selectively operated to produce an electric signal representing a discharge frequency of water from the water tank 11. As shown in FIG. 1, the thermal sensor 44 is provided on an outlet portion of evaporator 13 to produce an electric signal indicative of a temperature of refrigerant discharged from evaporator 13.

Hereinafter, the operation of the electric control apparatus will be described in detail. Assuming that a power source switch (not shown) has been closed to apply an AC voltage to the input buses $L_1$, $L_2$, the computer 40 is applied with a DC voltage from the DC power source circuit 70 to initial execution of the main control program at step 100 shown in FIG. 3. In a condition where the ice stocker 35 is not yet filled with ice cubes, the thermostat switch 54 is in its open position to prohibit the supply of DC voltage to the computer 40. When the program proceeds to step 102 for an initial setting, the computer 40 sets a first flag WFLG for supply of the water and a second flag VFLG for checking the DC voltage respectively as "0" and sets a cycle count value N as "0". At step 102, the computer further initializes various variables for execution of the main control program, and the output gate 41 is turned on.

When the program proceeds to step 104 for an initial water supply cycle, the switching transistor 64 is turned on, and the solenoid 23*a* of water valve 23 is energized under control of the relay switch 63. Thus, the water valve 23 is opened to permit the supply of fresh water into the watering pipe 21 from the water service pipe 22. In turn, the fresh water from watering pipe 21 falls along the rear surface 12*b* of ice making plate 12 and flows into the water tank 11. The initial cycle for supply of the water is repeated under control of a timer for a predetermined time (for instance, 1 minute). Upon lapse of the predetermined time, the program proceeds to step 106 where the computer 40 determines whether the float switch 34 is closed or not. When the level of water in tank 11 is still below the predetermined level, the float switch 34 is maintained in its open position. In such a condition, the computer 40 determines a "No" answer at step 106 to repeat the initial cycle for supply of the water.

When the level of water in tank 11 reaches the predetermined level to close the float switch 34, the computer 40 determines a "Yes" answer at step 106 and causes the program to proceed to step 108. At step 108, the computer 40 causes the switching transistor 56 to turn on for energizing the relay coil 55*b*. Thus, the normally open contact 55*a* of relay switch 55 is closed in response to energization of the relay coil 55*b*, and in turn, the relay coil 51*b* is energized to close the normally open contact 51*a* of relay 51. As a result, the electric motor 14*a* is activated to start the refrigerant compressor 14 for circulating the refrigerant through the condenser 16, expansion valve 17 and evaporator 13 in the refrigeration circuit. Thereafter, the computer 40 executes a defrost cycle control rountine, an ice making cycle control rountine and a drain cycle control rountine, respectively at step 110, 114 and 116, as will be described later.

When applied with an interruption signal from the timer during execution of the main control program, the computer 40 initiates execution of the interruption program at step 200 shown in FIG. 7. At step 202 of the interruption program, the computer 40 counts up a first count value FDCT for detecting finish of the defrost cycle, a second count value WFCT for detecting finish of the water supply cycle, a third count value WOCT for controlling the drain cycle of water and a fourth count value VCCT for checking the input voltage, respectively with "1". During execution of the interruption control program, the input voltage is checked at step 204 through 224 to prohibit the electric control of the ice making machine when the input voltage of input buses $L_1$, $L_2$, $L_3$ has abnormally increased due to an error in connection to a plug socket, input of an abnormal voltage from the exterior or the like.

In a condition where the input voltage of input buses L1, L2, L3 is normally maintained, the voltage value Vin applied form the A/D converter 77 is determined to be about 2.5 volt less than a standard voltage Vref of 3.5 volt. Thus, the computer 40 determines a "Yes" answer at step 206 and makes the fourth count value VCCT clear at step 208 to maintain it less than a predetermined value $CT_6$ (for instance, a count value corresponding with 30 seconds). As a result, the computer 40 determines a "No" answer at step 210 and causes the program to proceed to step 226. Consequently, the second flag VFLG for checking the input voltage is maintained as the initial value of "0", and the output gate 41 is maintained in its on-condition.

Assuming that the input voltage has increased more than the standard voltage Vref, the computer 40 determines a "No" answer at step 206 and causes the interruption program to step 210. In this instance, the fourth count value VCCT increases during repetitive execution f the interruption program. If the input voltage drops in a short time, the computer 40 will make the fourth count value VCCT clear by processing at step 206 and 208 before it reaches the predetermined value $CT_6$. Thus, the second flag VFLG for checking the input voltage is maintained as the initial value of "0" and the output gate 41 is maintained in its on-condition. If the increase of the input voltage continues for a long time, the fourth count value VCCT will become more than the predetermined value $CT_6$. In such a condition, the computer 40 determines a "Yes" answer at step 210 and turns off the output gate 41 at step 212. Subsequently, the computer 40 changes the second flag VFLG for checking the input voltage to "1" indicative of an abnormal value. As a result, the output gate 41 is maintained in its off-position to prohibit the supply of control signals to the switching transistors 56, 58, 62, 64 from the computer 40 thereby to protect the components of the electric control apparatus.

In a condition where the second flag VFLG is set as the abnormal value "1", the computer 40 determines a "No" answer at step 204 and causes the program to proceed to step 216. If the input voltage is more than the standard value Vref under the abnormal condition, the computer 40 determines a "Yes" answer at step 216 and makes the fourth count value VCCT clear at step 218. As a result, the fourth count value VCCT for checking the input voltage is maintained less than the predetermined value $CT_6$. Thus, the computer 40 determines a "No" answer at step 220 and causes the program to proceed to step 226. Consequently, the second flag VFLG is maintained as the abnormal value "1", and the output gate 41 is maintained in its off-condition. If the input voltage is temporarily decreased during execution of the program before it reaches the predetermined value $CT_6$, the computer 40 will make the fourth count value VCCT clear by processing at step 216 and 218. Thus, the second flag VFLG is maintained as the abnormal value "1", and the output gate 41 is maintained in its off-condition.

When the input voltage becomes normal, the voltage value Vin is maintained less than the standard value Vref for a long time. In such a condition, the computer 40 determines a "No" answer at step 216 during repetitive execution of the interruption program, and in turn, the fourth count value VCCT reaches the predetermined value $CT_6$. As a result, the computer 40 determines a "Yes" answer at step 220, causes the output gate 41 to turn on at step 222 and resets the second flag VFLG to the initial value "0". Thus, the output gate 41 is maintained in its on-condition to permit the supply of control signals to the switching transistors 56, 58, 62, 64 from the computer 40.

Figure 4:
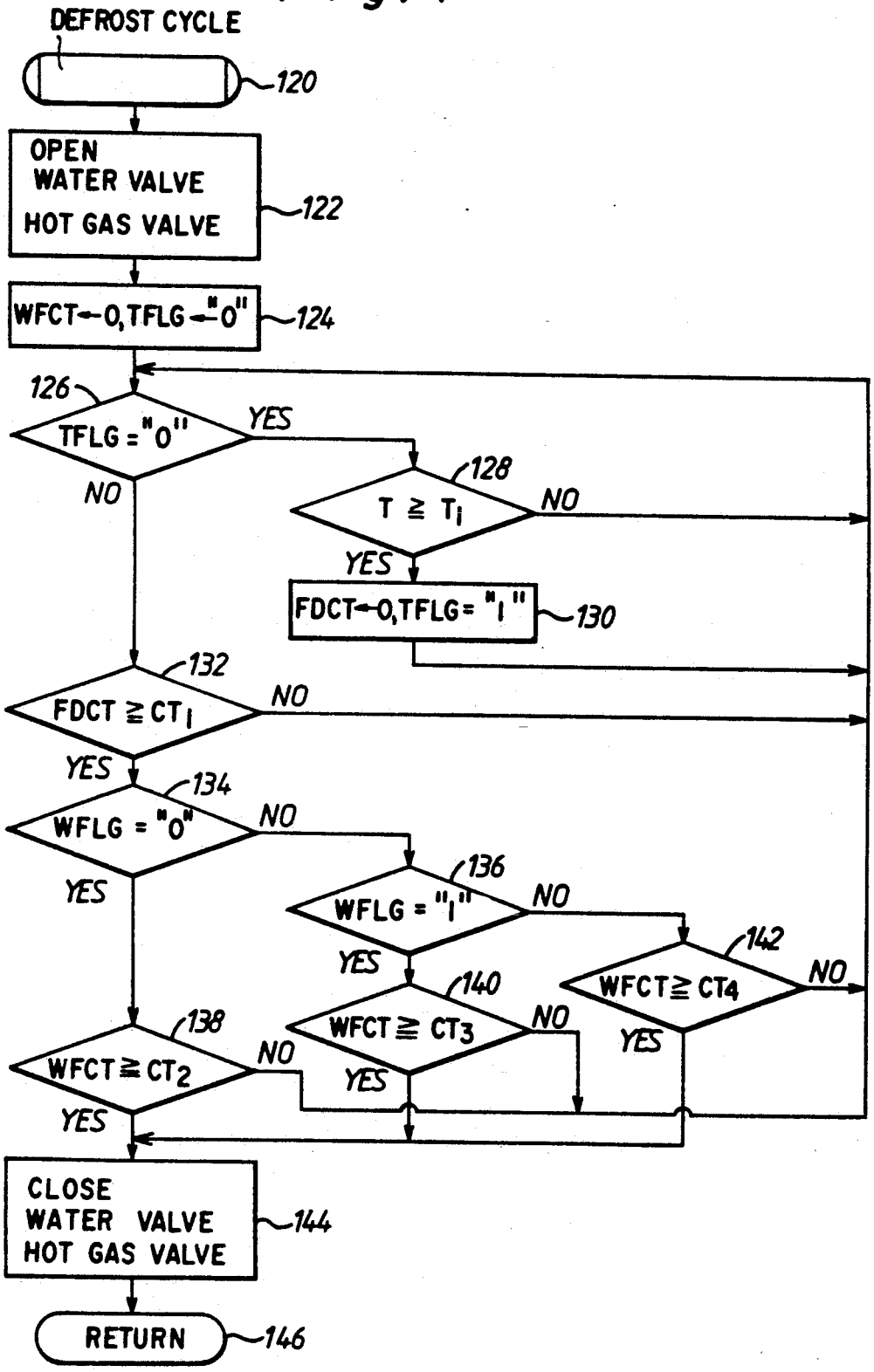
FIG. 4 is a flow chart of a defrost and water supply control routine shown in FIG. 3.

After processing of the interruption program, the computer 40 executes the main control program at step 110 to step 116 shown in FIG. 3. Assuming that the main control program has been returned to step 110, the computer 40 initiates execution of the defrost cycle control routine at step 120 shown in FIG. 4 and causes the switching transistors 64, 58 to turn on at step 122. Thus, the normally open contact 63*a* of relay switch 63 is closed in response to energization of the relay coil 63*b* to energize the solenoid 23*a* of water valve 23, and the movable contact 57*a* of relay switch 57 is switched over in response to energization of the relay coil 57*b* to energize the solenoid 18*a* of hot gas valve 18. As a result, the water valve 23 is opened to supply fresh water into the watering pipe 21 from the water service pipe 22, while the hot gas valve 18 is opened to permit the supply of compressed hot gas into the evaporator coil 13 from the compressor 14. When the program proceeds to step 124, the computer 40 resets the second count value WFCT to "0" and sets a fourth flag TFLG for temperature detection as "0". Thus, the second count value WFCT is counted up by "1" at each execution of the interruption program.

After processing at step 124, the computer 40 executes the defrost cycle control routine at step 126 to 142 to release the ice cubes formed on the front surface 12*a* of ice making plate and to supply ice making water into water tank 11. Immediately after operation of the power source switch, however, any ice cubes may not be formed on the ice making plate 12. For this reason, the execution of the defrost cycle control routine will be described later. Assuming that the first flag WFLG for supply of the water is maintained as "0" after processing at step 126 to 132, the computer 40 determines a "Yes" answer at step 134 and determines at step 138 whether the second count value WFCT is more than or equal to a second predetermined value $CT_2$ (for instance, a count value corresponding with two minutes). If the second count value WFCT is less than the second predetermined value $CT_2$, the computer 40 determines a "No" answer at step 138 and returns the program to step 126. When the second count value WFCT exceeds the second predetermined value $CT_2$, the computer 40 determines a "Yes" answer at step 138, causes the switching transistors 64, 58 to turn off at step 144 and finishes the execution of the defrost cycle control rountine at step 146. Thus, the normally open contact 63*a* of relay switch 63 is opened to deenergize the solenoid 23*a* of water valve 23, while the movable contact 57*a* of relay switch 57 is switched over to deenergize the solenoid 18*a* of hot gas valve 18. As a result, the water valve 23 is closed to interrupt the supply of water into the watering pipe 21, and the hot gas valve 18 is closed to interrupt the supply of hot gas into the evaporator 13.

When the program proceeds to step 112 shown in FIG. 3 after execution of the defrost cycle control routine, the computer 40 determines whether the float switch 34 is close or not. If the level of water in tank 11 is below the predetermined level, the computer 40 determines a "No" answer at step 112 and returns the program to step 104 for the initial water supply cycle. When the float switch 34 is closed by increase of the water in tank 11, the computer 40 determines a "Yes" answer at step 112 and causes the program to proceed to for execution of the ice making cycle control rountine. During execution of the ice making cycle control routine, the computer 40 maintains the switching transistors 58, 62 non-conductive and turns on the switching transistor 56 to activate the electric motor 15*a* of cooling fan 15 under control of the relay switches 55, 57 and to effect forward rotation of the electric motor 25*a* of water pump 25 under control of the relay switches 55, 57 and 61. Thus, the watering pipe 24 is supplied with the ice making water from the water tank 11 through the water supply pipe 26 under forward rotation of the pump 25 and causes the supplied ice making water to flow down along the front surface 12*a* of ice making plate 12. In this instance, the hot gas valve 18 is closed under control of the relay switch 57, and the electric motor 14*a* of compressor 14 is activated under control of the relay switch 55. Thus, the evaporator 13 is supplied with expanded refrigerant from the expansion valve 17 under operation of the compressor 14 to freeze the water flowing down along the front surface 12*a* of ice making plate 12. When the water flowing down along the front surface 12*a* of ice making plate 12 is progressively frozen by the evaporator 13 into ice cubes A, the level of water in tank 11 will gradually lower to the predetermined level at which the float switch 34 is opened. When the float switch 34 is opened, the computer 40 turns on the switching transistor 58 and turns off the switching transistor 56 to deactivate the electric motors 15*a* and 25*a* under control of the relay switches 55 and 57 and to deactivate the electric motor 14*a* of compressor 14 under control of the relay switch 55. Thus, the cooling fan 15, water pump 25 and compressor 14 are stopped to finish the ice making cycle.

Figure 5:
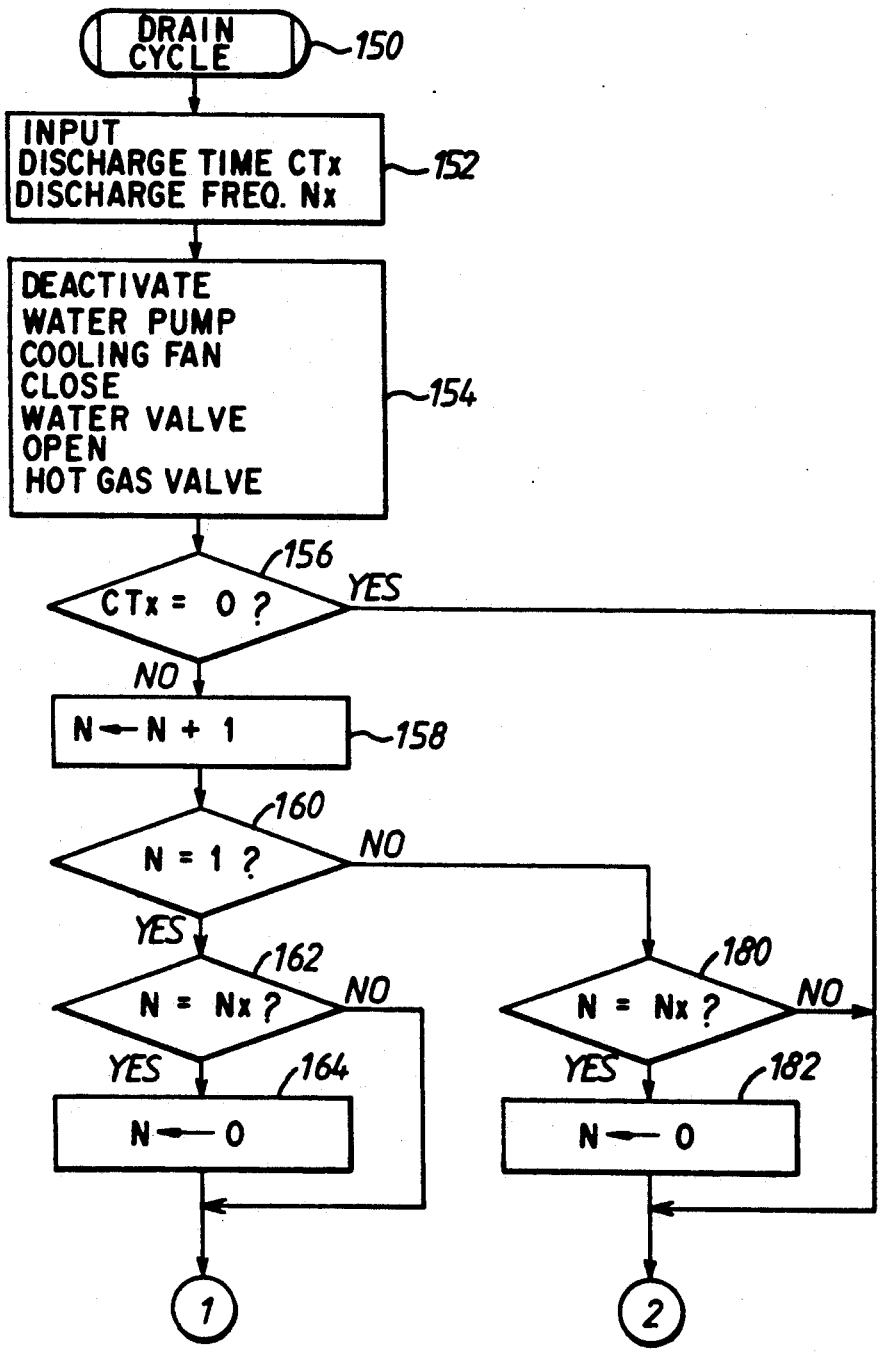
FIGS. 5 and 6 illustrate a drain cycle control routine shown in FIG. 3.
Figure 6:
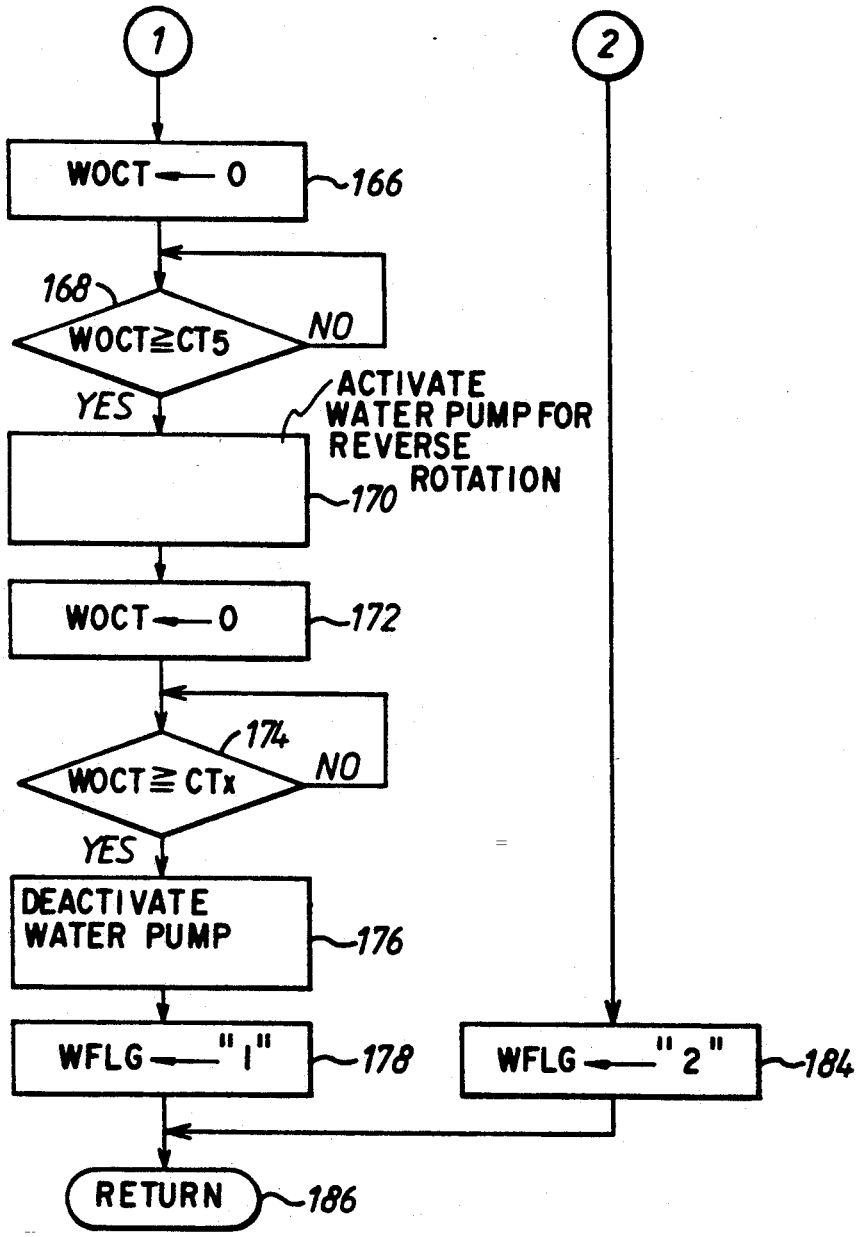

After execution of the ice making cycle control routine, the main control program proceeds to step 118 shown in FIG. 3 to execute the drain cycle control routine shown by a flow chart in FIGS. 5 and 6. Thus, the computer 40 initiates execution of the drain cycle control routine at step 150 and sets at step 152 a discharge time value $CT_x$ indicative of a condition of the discharge time setting switch 42 and a discharge frequency $N_x$ indicative of a condition of the discharge frequency setting switch 43. In this embodiment, the discharge time value $CT_x$ is set in accordance with the level of water in tank 11 detected by the float switch 34. At the following step 154, the computer 40 turns on the switching transistor 58 and turns off the switching transistors 62, 64 to energize the solenoid 18*a* of hot gas valve 18 under control of the relay switch 57 and to deactivate the electric motor 25a of water pump 25 and the solenoid 23a of water valve 23 under control of the relay switches 61 and 63. Thus, the hot gas valve 18 is opened, the cooling fan 15 and water pump 25 are stopped, and the water valve 23 is closed.

After processing at step 154, the computer 40 determines at step 156 whether the discharge time value $CT_x$ is "0" or not. If the answer at step 156 is "No", the program proceeds to step 158 where the computer 40 adds "1" to the cycle count value N. At the following step 160, the computer 40 determines whether the cycle count value N is "1" or not. At his initial drain cycle, the cycle count value N is set as "1" at step 158 after set as "0" at step 102 shown in FIG. 3. Thus, the computer 40 determines a "Yes" answer at step 160 and determines at step 162 whether or not the cycle count value N is equal to the discharge frequency $N_x$. If the discharge frequency $N_x$ is set as a value different from "1" such as "2", "5" or "10", the computer 40 determines a "No" answer at step 162 and causes the program to proceed to step 166 shown in FIG. 6.

Subsequently, the computer 40 makes the third count value WOCT clear to "0" at step 166 and determines at step 168 whether or not the third count value WOCT is more than or equal to the predetermined value $CT_5$. When the third count value WOCT reaches the predetermined value $CT_5$ by execution of the interruption program, the computer 40 determines a "Yes" answer at step 168 and causes the program to proceed to step 170. At step 170, the computer 40 turns on the switching transistor 62 and maintains the switching transistor 58 conductive to effect reverse rotation of the electric motor 25a under control of the relay switches 57 and 61. Thereafter, the computer 40 makes the third count value WOCT clear to "0" at step 172 and determines at step 174 whether or not the third count value WOCT is more than or equal to the discharge time value $CT_x$. Upon lapse of a period of time defined by the discharge time value $CT_x$, the computer 40 determines a "Yes" answer at step 174 and turns off the switching transistor 62 at step 176 to deactivate the electric motor 25a of water pump 25 under control of the relay switch 61. In such a control as described above, the reverse rotation of water pump 25 is maintained for the period of time defined by the discharge time value $CT_x$ to supply the ice making water into the discharge pipe 27 from the water tank 11. As a result, the pressure valve 28 is opened to permit the ice making water discharged therethrough from the water tank 11 into the overflow pipe 31. In this instance, a portion of the ice making water is supplied into the sub-tank 33 through pipe 32 for washing the float switch 34. Finally, the computer 40 resets the water supply flag WFLG as "1" at step 178 and returns the program to step 110 for the defrost cycle control routine at step 186.

When the main control program returns to step 110, the computer 40 executes processing at step 122 to open the water valve 23 for supplying fresh water from the water service pipe 22 into the watering pipe 21 and to open the hot gas valve 18 for supplying hot gas into the evaporator coil 13. At the following step 124, the computer 40 resets the second count value WFCT tot he initial value of "0" and sets the temperature detection flag TFLG to the initial value of "0". Thus, the upright ice making plate 12 is supplied with the fresh water from the watering pipe 21 and warmed by the hot gas supplied into the evaporator coil 13 to release the frozen ice cubes A therefrom. Simultaneously, the second count value WFCT is counted up from "0".

After processing at step 122 and 124, the computer 40 determines at step 126 whether the temperature detection flag TFLG is "0" or not. In this instance, the temperature detection flag TFLG is reset previously at step 124. Thus, the computer 40 determines a "Yes" answer at step 126 and causes the program to proceed to step 128. At step 128, the computer 40 determines whether or not a refrigerant temperature detected by the thermal sensor 44 is higher than or equal to a predetermined temperature $T_1$. In this embodiment, the predetermined temperature $T_1$ is defined to correspond with a temperature (for instance, 9 centigrade) at which the frozen ice cubes A start to be released from the ice making plate 12 during the defrost cycle. When the temperature of ice making plate 12 and evaporator coil 13 is still lower than the predetermined temperature $T_1$ at an initial stage of the defrost cycle, the computer 40 determines a "No" answer at step 128 and returns the program to step 126. When the temperature at the outlet portion of evaporator coil 13 becomes equal to or higher than the predetermined temperature $T_1$, the computer 40 determines a "Yes" answer at step 128 and causes the program to proceed to step 130. At step 130, the computer 40 resets the first count value FDCT to the initial value of "0" and changes the temperature detection flag TFLG to "1". Thereafter, the program is returned to step 126, and the first count value FDCT is counted up by execution of the interruption program.

When the program is returned to step 126 after processing at step 130, the computer 40 determines a "No" answer and causes the program to proceed to step 132. At step 132, the computer 40 determines whether or not the first count value FDCT is more than or equal to a predetermined value $CT_1$ (for instance, a count value representing 1 minute). If the answer at step 132 is "No", the computer 40 returns the program to step 126 to repeat processing at step 132. When the first count value FDCT becomes equal to or more than the predetermined value $CT_1$, the computer 40 determines a "Yes" answer at step 132 and causes the program to proceed to step 134. In this instance, the frozen ice cubes A are released from the ice making plate 12 and received by the water plate 36 to be accumulated in the ice stocker 35.

At step 134, the computer 40 determines whether the water supply flag WFLG if "0" or "1". Since the water supply flag WFLG if previously set as "1" at step 178 during the drain cycle, the computer 40 determines a "No" answer at step 134 and determines a "Yes" answer at step 136. Thus, the computer 40 determines at step 140 whether or not the second count value WFCT is more than or equal to a predetermined value $CT_3$. In this embodiment, the predetermined value $CT_3$ is defined to be larger than the predetermined value $CT_2$ during which the water tank 11 is filled with fresh water after the drain cycle. For instance, the predetermined value $CT_3$ is defined to correspond with 3 minutes. When the second count value WFCT is still less than the predetermined value $CT_3$, the computer 40 determines a "No" answer at step 140 and returns the program to step 126 to repeat processing at step 126, 132–136 and 134 during which the water valve 23 is maintained in its open position to continue the supply of fresh water into the water tank 11. When the second count value WFCT becomes equal to or more than the predetermined value $CT_3$ by execution of the interruption program, the computer 40 determines a "Yes" answer at step 140 and closes the water valve 23 and hot gas valve 18 at step 144 in the same manner as described above. As a result, the supply of fresh water into the water tank 11 is interrupted by the water valve 23, and a sufficient amount of fresh water is stored in the water tank 11 after the drain cycle.

After the defrost and water supply cycle, the ice making cycle will be carried out in the same manner as described above. Thereafter, the drain cycle will be carried out as described below. Assuming that the program has proceeded to step 158, after processing at step 152–156, the computer 40 changes the cycle count value N to "2" by addition of "1". Thus, the computer 40 determines a "No" answer at step 160 and causes the program to proceed to step 180. After processing at step 180 and 182, the computer 40 sets the water supply flag WFLG to "2" at step 184 shown in FIG. 6. In this instance, the drain cycle may not be carried out to avoid discharge of the ice making water form the water tank 11.

At the following defrost and water supply cycle, the computer 40 determines a "No" answer respectively at step 134 and 136 after processing at step 122–132 and causes the program to proceed to step 142. At step 142, the computer 40 determines whether the second count value WFCT is equal to or more than a predetermined value $CT_4$. In this embodiment, the predetermined value $CT_4$ is defined to correspond with a period of time during which the consumed water for ice making is supplemented with fresh water newly supplied from the water service pipe 22. For instance, the predetermined value $CT_4$ is defined to be about 2 minutes. Thus, the computer 40 determines a "No" answer at step 142 until the second count value WFCT becomes equal to or more than the predetermined value $CT_4$ and repeats processing at step 126, 132–136 and 142 to permit the supply of fresh water into the water tank 11 from the water service pipe 22. When the second count value WFCT becomes equal to or more than the predetermined value $CT_4$, the computer 40 determines a "Yes" answer at step 142 and causes the program to proceed to step 144. As a result, the water valve 23 and hot gas valve 18 are closed by processing at step 144 to finish the defrost and water supply cycle at step 146, and a sufficient amount of fresh water is stored in the water tank 11 for the following ice making cycle.

At the drain cycle after the following ice making cycle, the cycle count value N is maintain as "2". If the discharge frequency $N_x$ is previously set as "2" at step 152, the computer 40 determines a "Yes" answer at step 180 and resets the cycle count value N to "0" at step 182. When the cycle count value N becomes "1" by addition of "1" at step 158 during the following drain cycle, the computer 40 determines a "Yes" answer at step 160 and executes processing at step 162–178 in the same manner as described above to discharge the ice making water from the water tank 11. In this instance, the water supply flag WFLG is set as "1" by processing at step 178. Thus, the water supply time at the following defrost and water supply cycle is defined by the predetermined value $CT_3$. As is understood from the above description, when the discharge frequency $N_x$ has been set as "2", the ice making water is discharged from the water tank 11 every second time of carrying out a series of the defrost and water supply cycle, ice making cycle and drain cycle. In the case that the discharge frequency $N_x$ has been set as "5" or "10", the computer 40 determines a "Yes" answer at stp 180 every five or ten cycles to conduct discharge of the ice making water. When the discharge frequency $N_x$ has been set as "1", the computer 40 determines a "Yes" answer at step 162 during the drain cycle and resets the cycle count N to "0" at step 164 to conduct discharge of the ice making water at each drain cycle.

In the case that the discharge time value $CT_x$ has been set as "0", the computer 40 determines a "Yes" answer at step 156, sets the water supply flag WFLG as "2" at step 184 and ends the drain cycle at step 186. Thus, discharge of the ice making water may not be conducted. In this instance, the supply of fresh water is stopped when the count value WFCT becomes more than the predetermined value $CT_4$.

Since in the embodiment, the discharge of ice making water is controlled by processing at step 158–182 to be conducted at each cycle defined by the discharge frequency $N_x$, the ice making water is discharge from the water tank only when an amount of contaminants has been accumulated therein. This is useful to avoid useless discharge of the ice making water. Additionally, the discharge frequency $N_x$ can be selected by the user in accordance with the quality of water to provide ice cubes of high quality. Furthermore, the water supply time during the defrost and water supply cycle can be controlled by processing at step 178, 184 and 134–142 to enhance the saving effect of water.

What is claimed is:

1. An electric control apparatus for an ice making machine having a water tank arranged to store an amount of ice making water, an upright ice making plate arranged above the water tank, a water valve arranged to be opened during a defrost and water supply cycle of operation for supplying fresh water into the water tank through the ice making plate, a refrigeration circuit including an evaporator arranged for thermal exchange with the ice making plate, a water pump arranged to circulate the fresh water from the water tank to the upright ice making plate during an ice making cycle of operation and to discharge the water remain in the water tank at a drain cycle of operation after the ice making cycle of operation, comprising:

means for repetitively conducting the defrost and water supply cycle of operation, the ice making cycle of operation and the drain cycle of operation in sequence;

means for counting up a cycle count value at each time when the ice making cycle is conducted;

means for selectively predetermining a discharge frequency of the water remained int he water tank;

first control means for prohibiting the drain cycle of operation when the cycle count value is less than reference value indicative of the predetermined discharge frequency and for allowing the drain cycle of operation when the cycle count value becomes equal to the reference value; and second control means for maintaining the defrost and water supply cycle of operation for a first predetermined time when the drain cycle of operation is allowed and for maintaining the defrost and water supply cycle of operation for a second predetermined time shorter than the first predetermined time when the drain cycle of operation is prohibited.

2. An electric control apparatus for an ice making machine as recited in claim 1, wherein the first predetermined time is defined to store a sufficient amount of fresh water in the water tank at the defrost and water supply cycle of operation, while the second predetermined time is defined to supply fresh water into the water tank for supplement of the water consumer at the ice making cycle of operation.

3. An electric control apparatus for an ice making machine recited in claim 1, wherein said second control means comprises means for measuring lapse of the first or second predetermined time after the drain cycle of operation.

4. An electric control apparatus for an ice making machine as recited in claim 1, further comprising:

first detecting means for detecting a finish of the defrost cycle;

second detecting means for detecting a finish of the water supply cycle;

controlling means for controlling the drain cycle;

checking means for checking an input voltage, wherein said first and second detecting means, said controlling means, and said checking means are coupled to said means for counting up a cycle count value.

5. An electric control apparatus for an ice making machine as recited in claim 1, wherein said means for repeatedly conducting the defrost cycle comprises a computer means coupled to said water valve, said refrigeration circuit, and said water pump, and wherein said mans repeatedly controlling the water valve, the refrigeration circuit and the water pump to conduct the defrost cycle, the ice making cycle, and the drain cycle.

* * * * *